United States Patent [19]

Oki et al.

[11] 3,989,553

[45] Nov. 2, 1976

[54] PROCESS FOR PRODUCING MARAGING-STEEL CYLINDER FOR URANIUM ENRICHING CENTRIFUGAL SEPARATOR AND CYLINDERS PRODUCED THEREBY

[75] Inventors: Tsuguaki Oki, Kobe; Masatoshi Sudo, Akashi; Hiromori Tsutsumi, Nishinomiya; Koji Hosomi, Itami; Ichiro Tsukatani, Akashi; Teruyuki Takahara, Osaka, all of Japan

[73] Assignee: Kobe Steel Ltd., Kobe, Japan

[22] Filed: July 29, 1974

[21] Appl. No.: 492,726

[30] Foreign Application Priority Data

July 27, 1973 Japan ..... 48-84774
Dec. 13, 1973 Japan ..... 48-139394

[52] U.S. Cl. ..... 148/12.3; 148/142

[51] Int. Cl.[2] ..... C21D 9/14

[58] Field of Search ..... 148/12.3, 142

[56] References Cited

UNITED STATES PATENTS

| | | | |
|---|---|---|---|
| 3,365,342 | 1/1968 | Richardson et al. | 148/142 |
| 3,453,153 | 7/1969 | Tuffnell et al. | 148/142 |
| 3,573,109 | 3/1971 | Levy et al. | 148/11.5 R |
| 3,623,920 | 11/1971 | Kondo et al. | 148/142 |

*Primary Examiner*—W. Stallard
*Attorney, Agent, or Firm*—Oblon, Fisher, Spivak, McClelland & Maier

[57] ABSTRACT

Maraging-steel cylinders for uranium enriching centrifugal separators are made by drawing a blank of maraging-steel into a cylindrical shape, squeezing the drawn blank, and subjecting the squeezed cylinder to aging.

14 Claims, 18 Drawing Figures

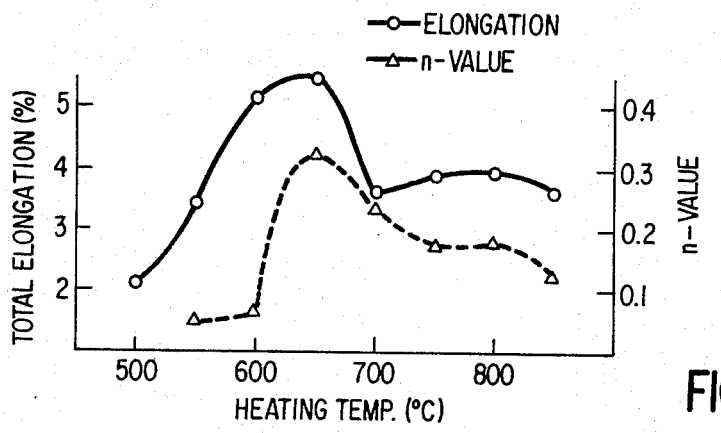
FIG. 3
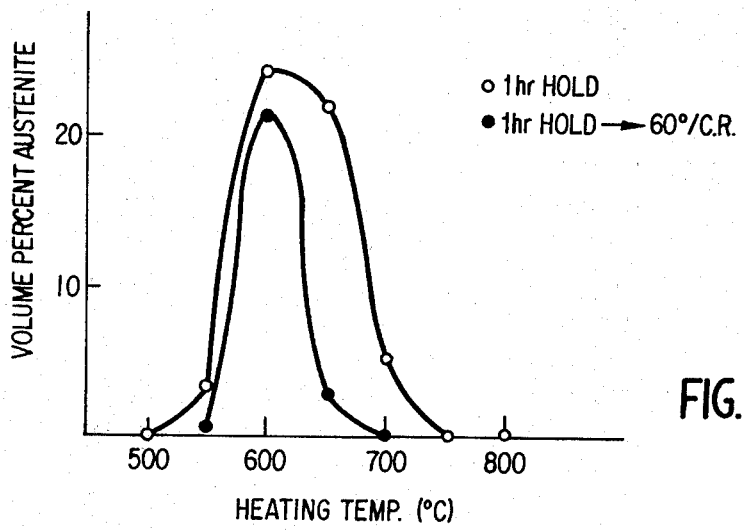
FIG. 4
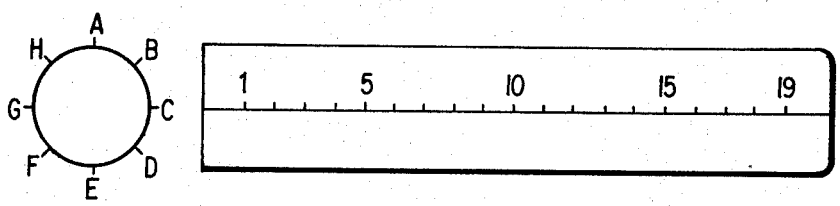
FIG. 16
FIG. 17
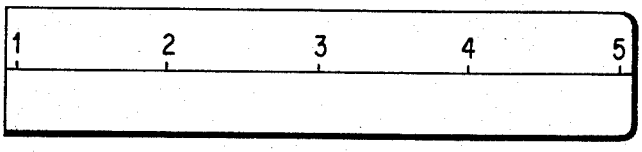

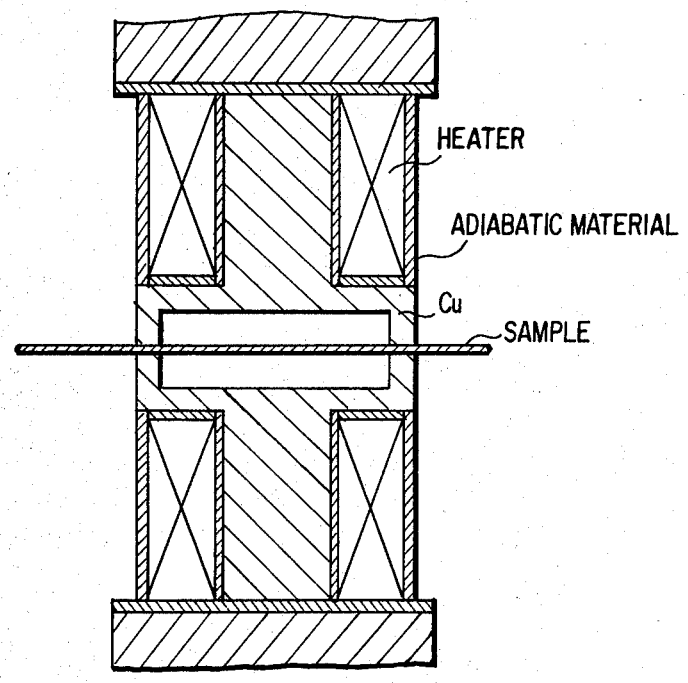
FIG. 8
FIG. 11
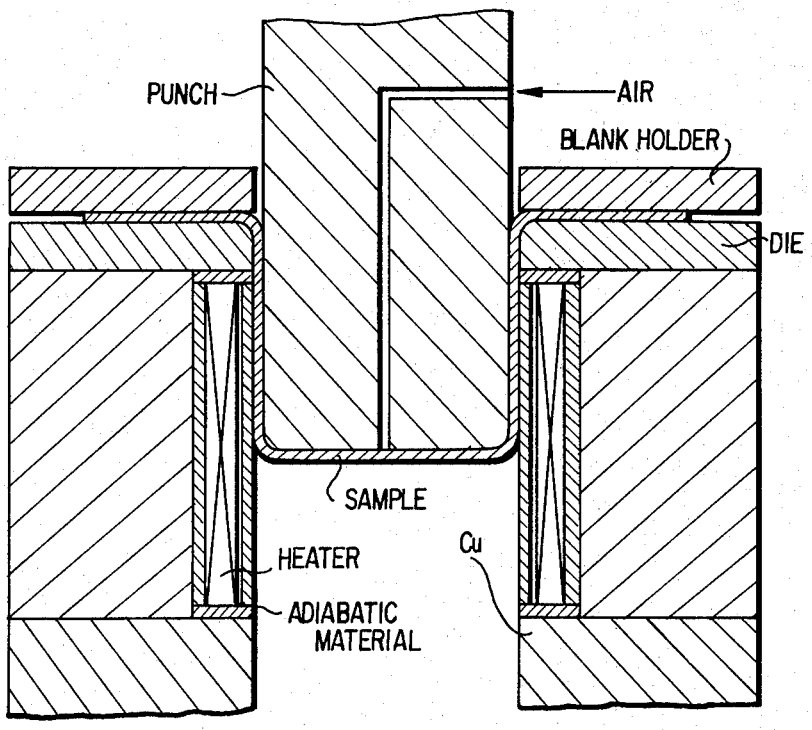

PROCESS FOR PRODUCING MARAGING-STEEL CYLINDER FOR URANIUM ENRICHING CENTRIFUGAL SEPARATOR AND CYLINDERS PRODUCED THEREBY

BACKGROUND OF THE INVENTION

1. Field of the Invention

This invention relates to a process for producing a maraging steel cylinder for uranium enriching by a centrifugal separator and to cylinders produced thereby. More particularly, this invention relates to a process which uses drawing and ironing steps in producing the cylinders.

2. Description of the Prior Art

Known processes for producing enriched uranium, which are used for atomic power plants, are the gas diffusion process and the centrifugal separation process. Centrifugal separation has recently become popular because of the rapid development and progress in that process. Uranium enriching using a centrifugal separator utilizes the small difference in mass of $U^{235}$ and $U^{238}$, so that the peripheral speed of a rotor or cylinder for a separator must be greatly increased. This requirement dictates the use of material light in weight and high in strength. Maraging steel is typical of such materials.

More specifically, the peripheral speed of the rotor must be above 400 m/sec, such that the dimensional accuracy of the rotor must be strictly controlled or subjected to severe limitations in dimensions. Of course, dynamic and chemical characteristics and the cost of starting material and products must also be taken into account.

The characteristics of a rotor of the requisite type may be summarized as follows:

i. dimensional accuracy, ii. freedom of residual stress in products, iii. desired strength, including strength against rupture due to internal pressure, tensile strength, or the like, iv. low production cost and efficient or high productivity.

Heretofore, processes for producing maraging-steel rotors or cylinders for use in a uranium enriching centrifugal separator have included extrusion, welding or spinning. However, those prior art processes pose disadvantages which fail to meet the above requirements, particularly in accuracy of dimensions, efficiency of production and residual stress.

The drawing process is superior to other processes such as welding, spinning and extrusion for producing a cylindrical body. However, drawing has not been utilized because the resultant residual stress problem cannot be solved. In addition, the standard heat treatment of the 18% Ni-maraging-steel uses a solution heat treatment at 820° C and a subsequent aging treatment at 490° to 510° C so that the elongation from such a solution heat treatment is considerably low, resulting in many defects, such as cracking and the like, when the steel is drawn. A temperature range other than that of the solution heat treatment which will produce improved elongation, will result in lowered strength of the final products, when the products are subjected to the final aging treatment step.

For these reasons, there have been many difficulties in the production of rotors or cylinders for a uranium enriching centrifugal separator, thus resulting in the use of time consuming, low efficiency processes and poor quality products.

A need exists therefore for a process for producing a maraging steel cylinder or rotor which overcomes the prior art difficulties.

SUMMARY OF THE INVENTION

Accordingly, one object of the present invention is to provide a process for producing a maraging-steel cylinder or rotor for a uranium enriching centrifugal separator, which cylinders possess high dimensional accuracy.

Another object of the present invention is to provide maraging steel cylinders or rotors, which possess the desired strength, including strength against rupture due to internal pressure, tensile strength and the like.

Still another object of the present invention is to provide a process for producing maraging steel cylinders or rotors which is low in cost and highly efficient.

Yet another object of the present invention is to provide maraging steel cylinders or rotors, which are free of residual stress in the circumferential direction in the walls of the cylinder and in which the variation in the wall thickness is below 3/100 mm with respect to the longitudinal and circumferential directions of the cylinder and the straightness thereof is below 2/100 mm.

Briefly, these and other objects of the present invention as will hereinafter become more apparent can be attained by a maraging-steel, such as Ni-Co-Mo-Ti system maraging-steel which is subjected to drawing, ironing and aging. Preferably, a solution heat-treatment can be employed prior to the drawing step wherein the temperature for the solution heat treatment is slightly above the temperature at which the amount of retained $\gamma$ austenite in the maraging steel will be at the maximum. The drawing and ironing steps can be effected in several stages at a specific drawing ratio and ironing ratio. Further, a local heat treatment, such as aging can be applied to load-bearing portions of a maraging steel blank, i.e., those portions which bear against the portion of the punch profile radius in the drawing step.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein:

FIG. 3 is a plot showing the elongation and the n-value of KMS 18–20 maraging steel at various solution heat treatment temperatures;

FIG. 4 is a plot showing the amount of retained austenite at various solution heat treatment temperatures;

FIG. 8 is a view of a local aging apparatus for a maraging steel blank;

FIG. 11 is a cross-sectional view of an apparatus for locally aging a maraging blank which has been drawn to some extent;

FIG. 16 is a diagram showing the measuring points of a cylinder of FIG. 15; and

FIG. 17 is a diagram showing the measuring points of a cylinder used for measurements of the deviation from a perfectly round surface and the straightness of a cylinder according to the present invention.

DETAILED DESCRIPTION OF THE PREFERRED EMBODIMENTS

For better understanding of the process of the present invention, the principles incorporated therein will be described under separate sub-headings (A) to (E), before going into the detailed embodiments.

A. IMPROVEMENTS IN WORKABILITY OF MARAGING STEEL ACCORDING TO LOWER TEMPERATURE SOLUTION HEAT TREATMENT, WHILE MAINTAINING DESIRED STRENGTH

As is well known, 18% Ni-maraging steel having high strength and toughness is excellently cold workable, and the cold working may be practiced in a solution-heat-treated state, followed by aging for obtaining the desired strength.

The prior art standard heat treatment for 18% Ni-maraging steel is carried out under the following conditions:

| | |
|---|---|
| Temperature of solution heat treatment | 820° C |
| Temperature of aging | 490° to 510° C |

Figure 1:
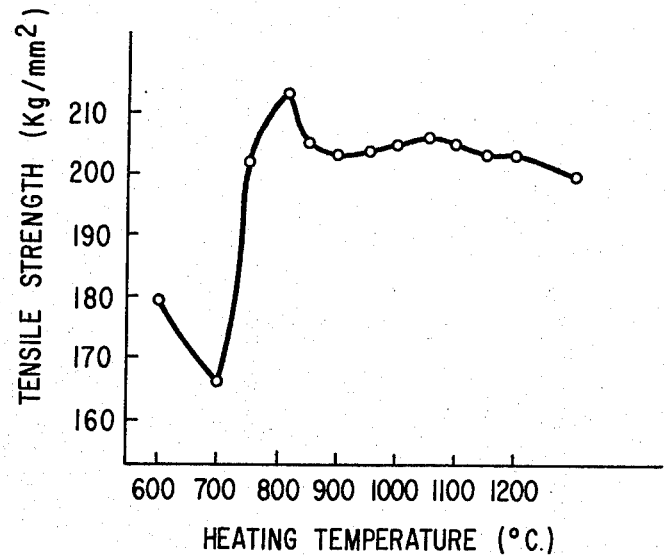
FIG. 1 is a plot showing the tensile strength of a KMS 18–20 maraging steel at various solution heat treatment temperatures in the standard procedure.
Figure 2:
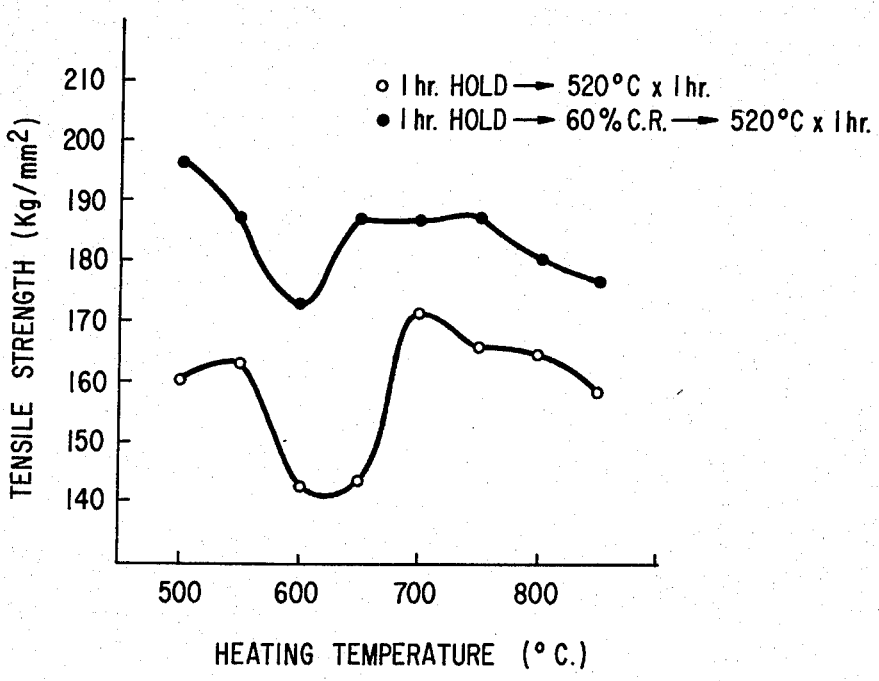
FIG. 2 is a plot showing the tensile strength of a KMS 18–20 maraging steel at various solution heat treatment temperatures.

This procedure is shown by FIG. 1 which indicates that maximum strength is obtained by maintaining steel at a temperature of 820° C for 1 hour for solution heat treatment, quenching the same in cold water and then subjecting the same to aging at 490° C for 3 hours. FIG. 1 further shows the appearance of a sharp decrease in strength when the steel is subjected to the solution heat treatment at 700° C. The sharp decrease in strength may be attributed to the presence of retained austenite. It has been widely accepted that the presence of the retained austenite exerts an adverse effect on the strength of steel after aging. However, the present experimental results show that a steel which has been subjected to a lower temperature solution heat treatment such as a temperature of about 700° C, exhibits excellent elongation and high $n$ value, thus affording good workability as compared with those subjected to the standard high temperature solution heat treatment, as shown in FIG. 3. More particularly, as shown in FIG. 4, the amount of retained austenite prior to working peaks at the solution heat treatment temperature of 600° to 650° C. In contrast, the elongation of the steel peaks at these temperatures, while the strength attains a minimum value, as shown in FIG. 2 and FIG. 3. This explains how the retained austenite contributes to the increase in elongation of steel, although the strength after aging is lowered.

It has been discovered that the above decrease in strength of the steel after aging may be prevented by working the retained austenite so that strain induced transformation is caused in the steel, with a resulting recovery of the desired strength. The possibility of causing transformation in the retained austenite, when subjected to the solution heat treatment at such a lower temperature, is well explained by the $\alpha' - \gamma$ reverse transformation mechanism.

Figure 5:
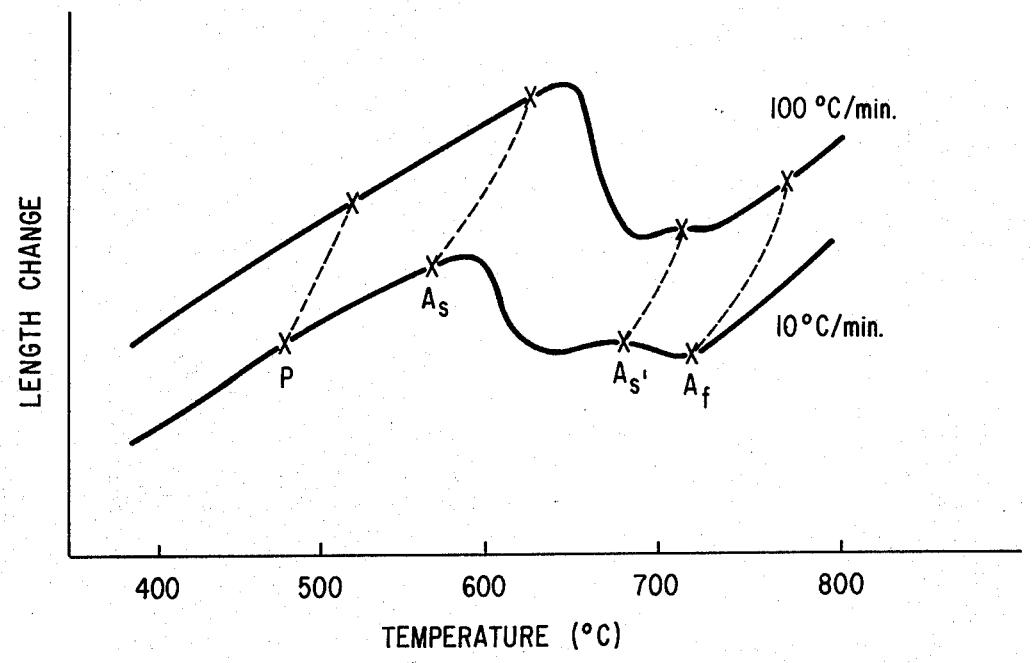
FIG. 5 is a plot showing the transformation point according to the measurements of thermal expansion at heating rates of 10° C/min and 100° C/min.
Figure 6:
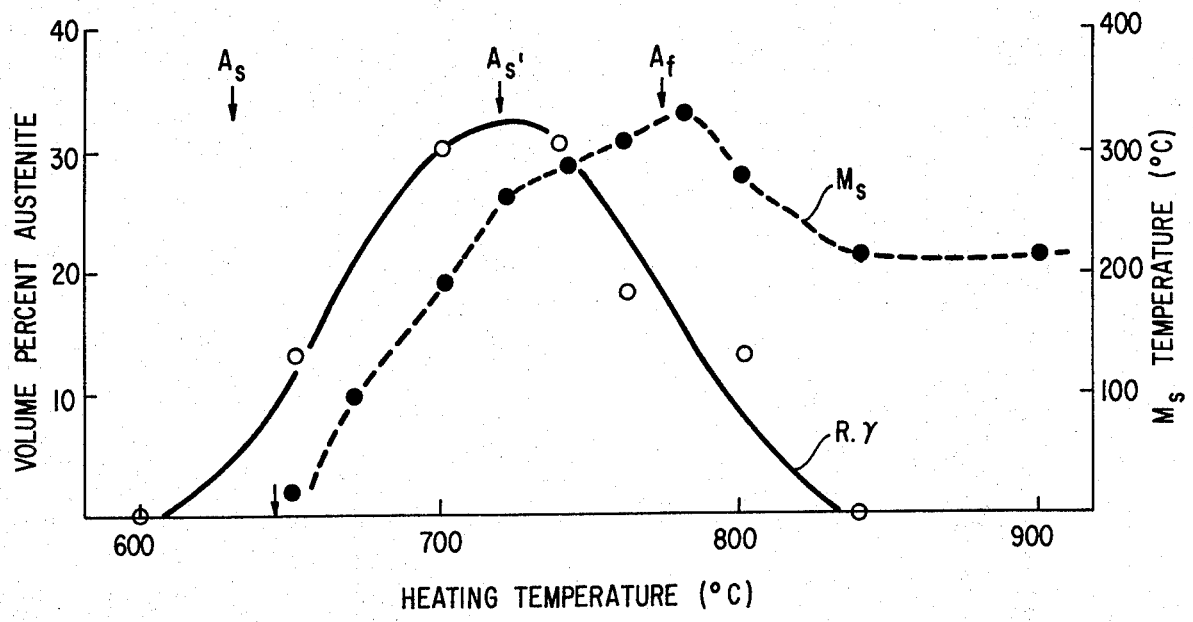
FIG. 6 is a plot showing the Ms point and the amount of retained austenite when the steel is cooled from different temperatures.
Figure 7:
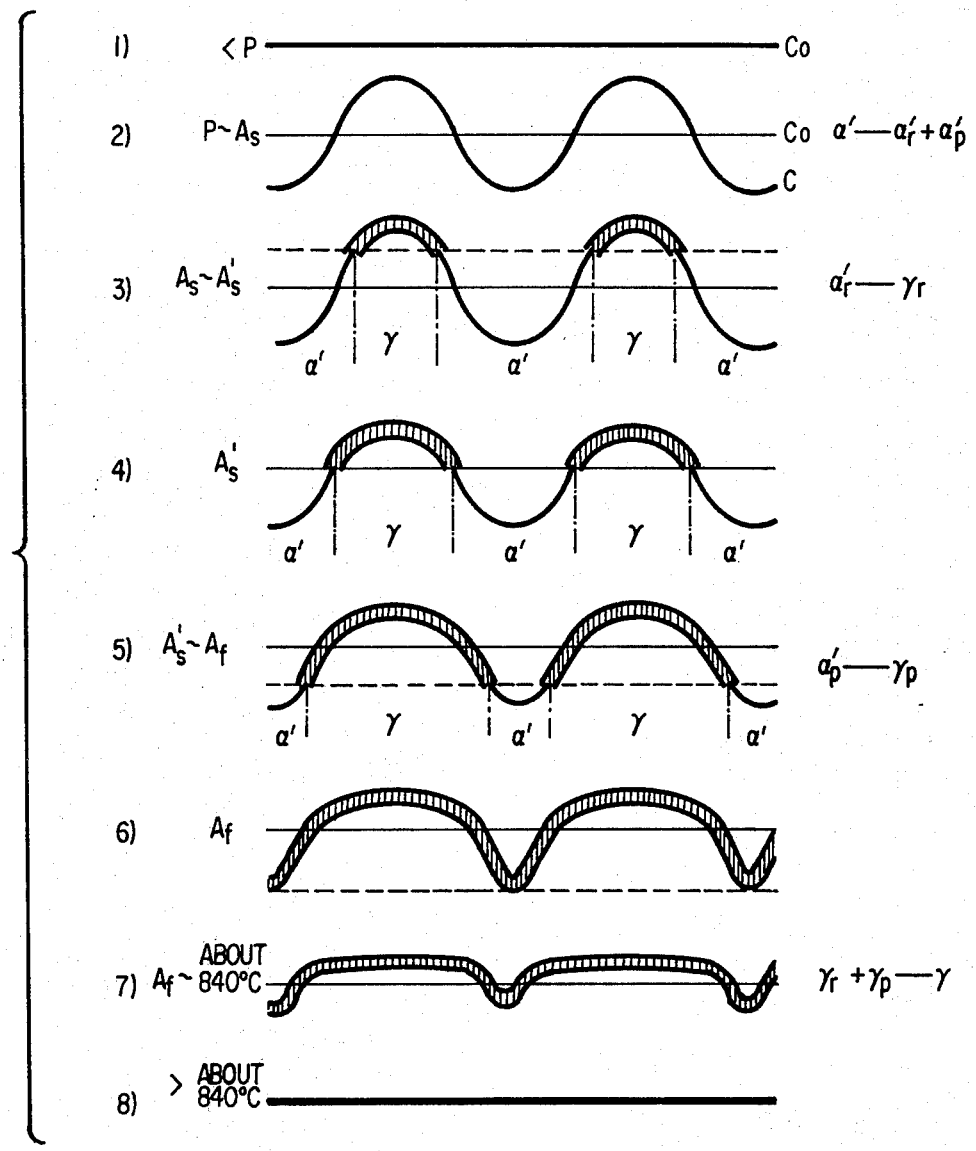
FIG. 7 is plots showing changes in the solute atom concentration in the course of a reverse transformation.

FIG. 5 shows the results of the measurements of the transformation point according to the measurements of thermal expansion at heating rates of 10° C/min and 100° C/min. As described above, FIG. 6 shows the results of the measurements of the amount of retained austenite and Ms point after being cooled from different temperatures. FIG. 7 shows diagrams of the solute atom concentration variation in the course of the reverse transformation.

In FIGS. 5 and 7, the solute atom concentration is uniform at temperatures below point P. However, at a temperature of P-As, there appears a change in the solute atom concentration, and at a temperature of As–As′, the transformation of solute rich $\alpha_r'$ to solute rich $\gamma_r$ takes place. Furthermore, at a temperature of As′ to Af, the transformation of solute poor $\alpha_p'$ to solute poor $\gamma_p$ takes place. Thus, at a temperature of Af, all $\alpha'$ will be turned into $\gamma$.

As the temperature increases further, the solute atom concentration in the $\gamma$ phase will begin to become uniform and, at temperatures above 840° C, the concentration will be completely uniform. In light of the above facts, it can be said that the $\gamma$ phase is high in the solute atom concentration and not apt to cause martensite transformation, as can be seen from the change of the point Ms. Hence, the $\gamma$ phase is stable.

On the other hand, the $\gamma$ phase which has appeared at the temperature of As′ to Af is low in the solute atom concentration and apt to cause martensite transformation, and thus the $\gamma$ phase is unstable. As a result, when solution heat treatments at various temperatures are applied, the $\gamma$ phase which is retained and subjected to higher temperature solution heat treatment as compared with the temperature which gives the maximum amount of retained austenite will produce a lower solute atom concentration and is unstable, tending to cause strain-induced transformation, as contrasted to that subjected to solution heat treatment at a temperature lower than the temperature which gives the maximum amount of retained austenite.

The aforesaid mechanism can also apply to KMS 18–17, 18–20 and 18–24, all of which are 18% Ni-maraging steels.

Thus, it may be concluded that a maraging steel having a high strength may be obtained by applying solution heat treatment thereto at a temperature higher than the temperature which gives the maximum amount of retained austenite in the solution-heat-treated state (at 650° to 700° C in FIG. 4) and then working the same, followed by aging.

In the process of the present invention, it should be noted that the drawing and ironing steps utilize the principle of drawing and ironing a maraging steel when the steel is high in elongation, and the anticipated decrease in strength after aging is prevented because of the working by the drawing and ironing after solution heat treatment but before aging.

B. FREEDOM OF RESIDUAL STRESS

As described earlier, a rotor or cylinder of a maraging steel used for a uranium enriching centrifugal separator is subjected to extremely high R.P.M. Thus, the presence of residual stress in the circumferential direction in the walls of a cylinder is a critical defect and should be minimized or removed.

It has now been found that the residual stress can be made negligible by ironing. This will be clear from the Examples below. In this process, the ironing ratio should be at least 20 percent.

C. IMPROVEMENTS IN L.D.R. BY LOCAL AGING TREATMENT

The limiting drawing ratio in the deep drawing of a cylindrical body depends on the difference between the deformation resistance of a blank at a flanged portion, the bending resisting force ($Ld$) and the strength ($Lf$) of the load bearing portion. Thus, if $Ld<Lf$, drawing will proceed satisfactorily. Conversely, if $Ld>Lf$ rupture will take place in a load bearing portion of the blank.

It follows from this that the strength of the load bearing portion of a blank should be increased relative to that of the flanged portion, so that the limiting drawing ratio (L.D.R.) may be improved. Known methods of increasing the strength of the load bearing portion of a blank include shot-peening the load bearing portion, or increasing the thickness of the load bearing portion relative to the peripheral portion thereof, or annealing the peripheral portion to lower the deformation resistance of the flanged portion. However, these methods have resulted in only partial success.

Figure 9:
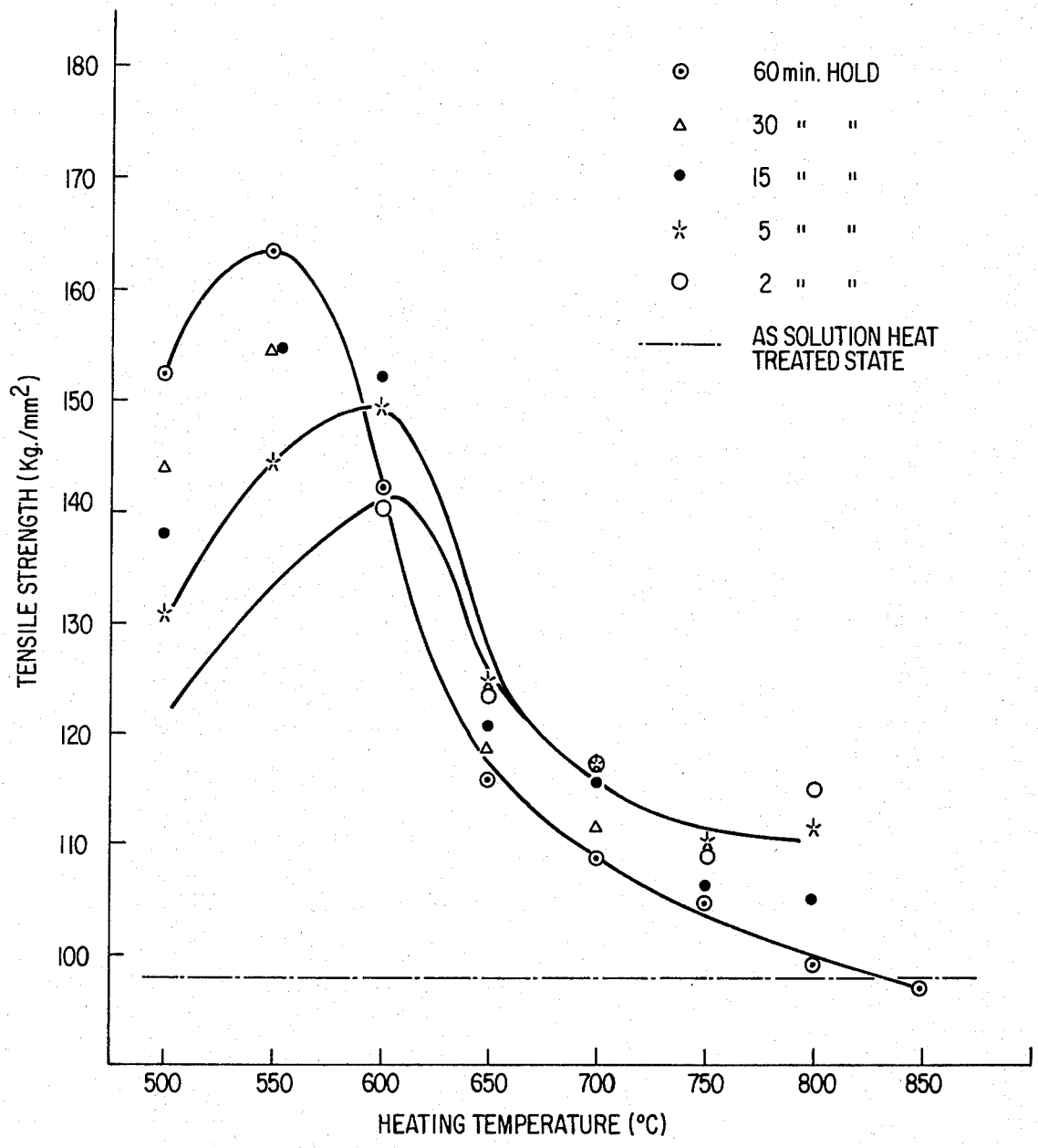
FIG. 9 is a plot showing the relationship between the aging temperature, time and strength.
Figure 10:
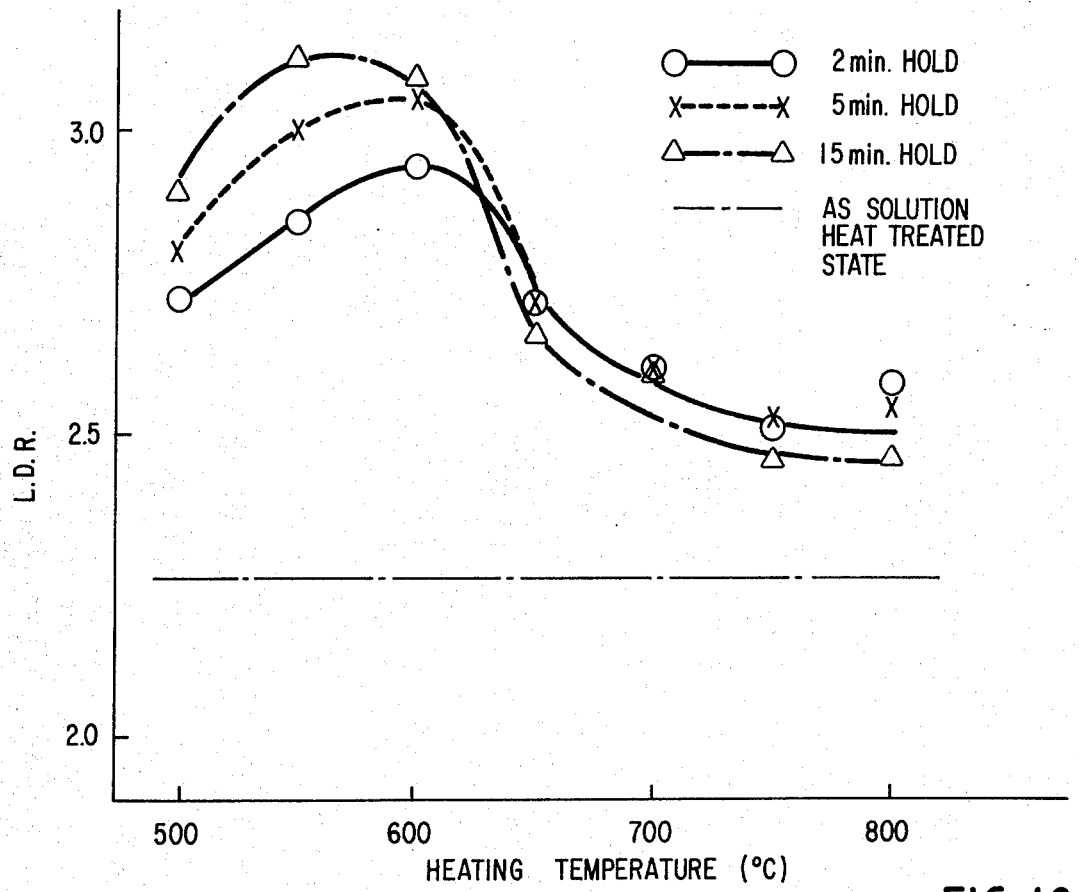
FIG. 10 is a plot showing the variation in L.D.R. at varying aging times and temperatures for a maraging steel which has been subjected to local aging treatment.

According to the present invention, the characteristics of a maraging steel, i.e., the increase in strength due to aging are utilized for the load bearing portion of a blank. The strength of 18%-Ni maraging steel will be doubled if aging is applied, as compared with steel in the solution heat treated state. Thus, the application of an aging treatment to the load bearing portion of a blank will improve the L.D.R. to a great degree. FIG. 8 shows the arrangement used in a local aging apparatus according to the present invention. FIG. 9 shows the relationship between the aging temperature, time and strength of a maraging steel. As can be seen from FIG. 9, as the aging time is decreased, the temperature representing the peak strength will shift toward the higher temperature side, with a decrease in the peak height. FIG. 10 illustrates the change in L.D.R. relative to the aging time and temperature of a maraging steel which has been subjected to the local aging step. The change in L.D.R. exhibits a tendency similar to that of strength. As shown, a blank with an L.D.R. of 2.26 becomes an L.D.R. of 3.15 by local heating or aging at 550° to 600° C for 15 minutes, and an L.D.R. of 2.95 when subjected to local aging at 600° to 620° C for 2 minutes. In this manner, the aging treatment of the load bearing portion of a maraging steel will improve the L.D.R. to a considerable extent. However, when severe deep drawing is applied to steels in a locally aged state, cracking will often occur because of bending of a blank at the shoulder portion of a die profile radius. To overcome this shortcoming, the apparatus shown in FIG. 11 may be used to age a blank from the time of drawing.

Temperature rise in the flanged portion of the blank must be avoided to prevent the flanged portion from being aged. For this reason, a suitable heating time is as short as 2 minutes at a temperature of 600° to 620° C. From such heating, the L.D.R. will be increased to 1.68 times higher than that of maraging steel which has not been subjected to such heat treatment. With the apparatus shown in FIG. 11, the aging treatment after working may be avoided, because of the aging treatment during drawing.

D. TENSILE STRENGTH AND STRENGTH AGAINST RUPTURE FROM INTERNAL PRESSURE IN SIDE WALL

The difference in strength in the circumferential direction of cylinders is not appreciable between those subjected to D.I. and those subjected to spinning, and the strength after aging was found to be 240 kg/mm$^2$. The rupture stress obtained from rupture tests was found to be 138 kg/mm$^2$ and 231 kg/mm$^2$ for samples before and after aging, respectively, which indicate no appreciable difference as compared with those subjected to spinning.

E. LOW PRODUCTION COST AND EFFICIENT AND HIGH PRODUCTIVITY

The superiority of the drawing and ironing steps according to the present invention versus spinning or welding is self-explanatory in every respect, particularly in terms of cost and efficiency of production.

According to the process of the present invention, a disk-like maraging steel plate or blank is preferably subjected first to the solution heat treatment at a temperature above that which would give the maximum amount of retained austenite, i.e., 650° to 700° C for 18%-Ni maraging steel. The steel blank is then subjected to drawings in a plurality of stages, e.g., in three stages. For such a case, the drawing ratio for the first drawing is 1.5 to 2.0 and the drawing ratio in the second and third stages is 1.0 to 1.5.

Figure 12:
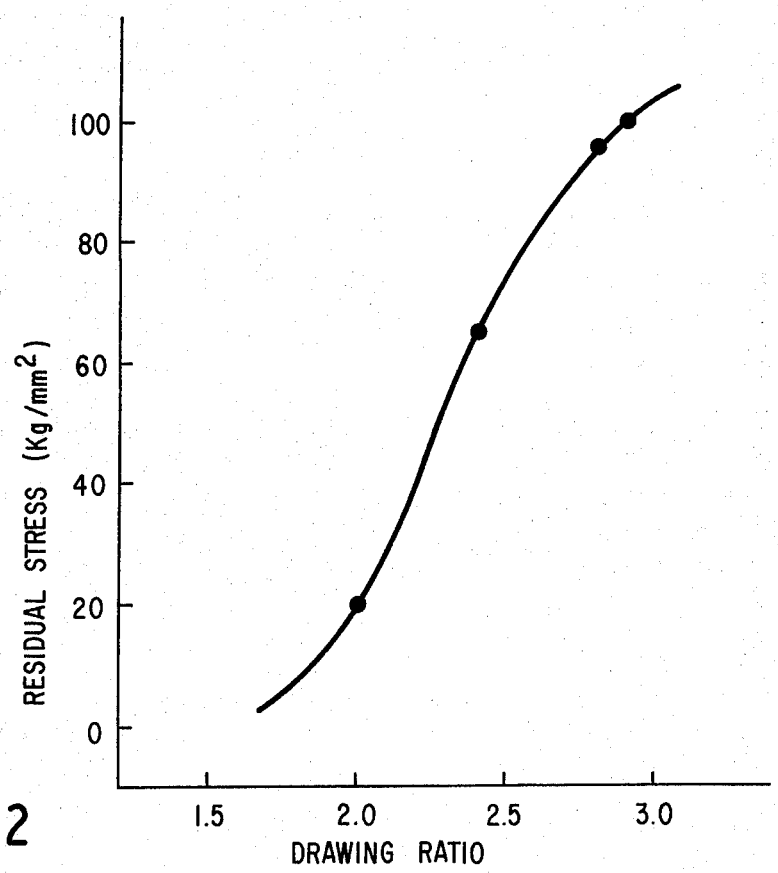
FIG. 12 is a plot showing the relationship between the drawing ratio and the residual stress in the circumferential direction, of a deep drawn cylinder of 18% Ni-maraging steel plate.

From this treatment, however, a residual tensile stress will arise in the walls of the cylinder in the circumferential direction. FIG. 12 shows the relationship between the drawing ratio and the residual stress in the circumferential direction for a cylinder of 18%-Ni base maraging steel. As can be seen from FIG. 12, the greater the drawing ratio, the greater the residual stress.

Figure 13:
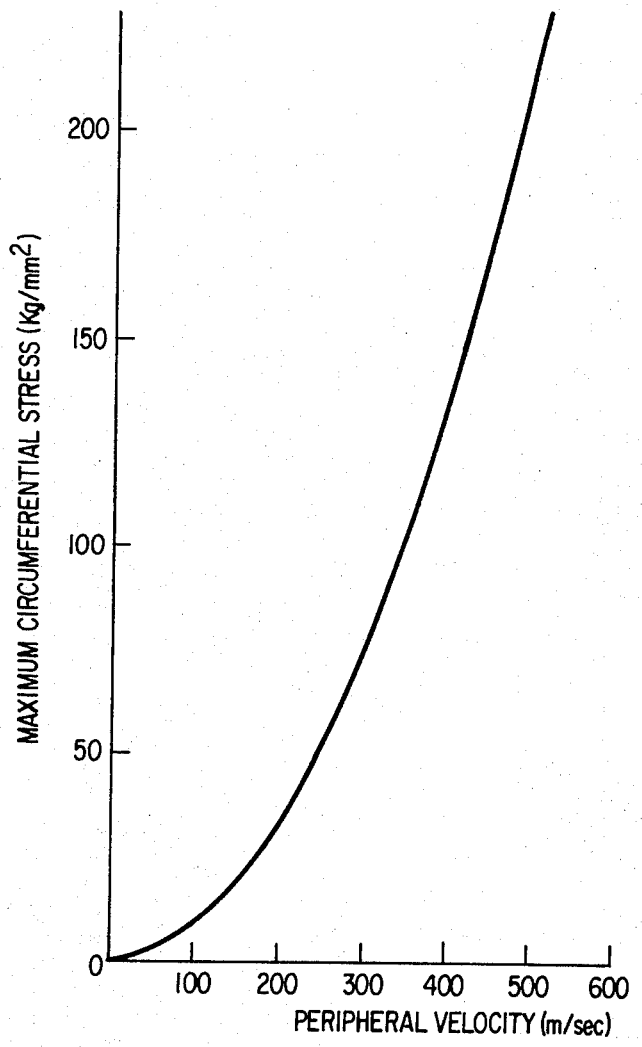
FIG. 13 is a plot showing the relationship between the peripheral velocity and the maximum circumferential stress of a 18% Ni-maraging steel cylinder.
Figure 14:
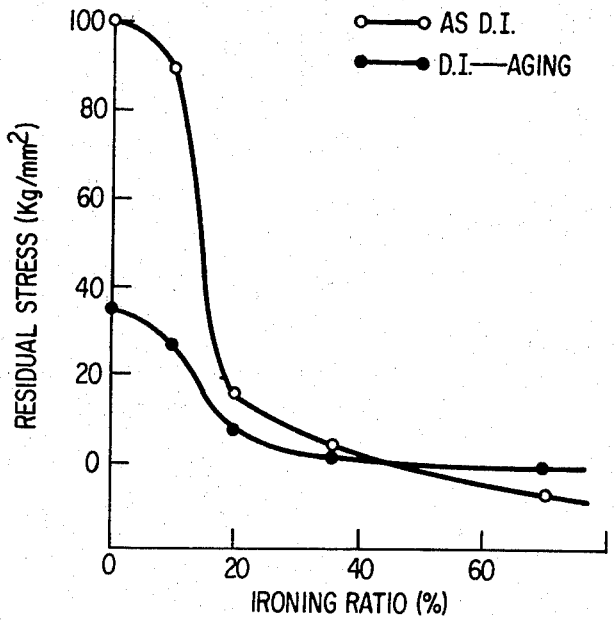
FIG. 14 is a plot showing the relationship between the ironing ratio and the residual stress of a 18% Ni-maraging steel cylinder which has been subjected to an ironing step according to the present invention and then an aging treatment.

If the cylinder thus prepared is utilized in a uranium enriching separator, considerable high tension will be created in the cylinder in the circumferential direction, as the R.P.M. of the cylinder is increased, as shown in FIG. 13. As a result, if residual stress exists in the cylinder, the R.P.M. should be reduced to an extent corresponding to the residual stress. To overcome this shortcoming, the present invention employs ironing following the drawing step to improve the dimensional accuracy. As shown in FIG. 14, the residual stress sharply decreases when the ironing ratio exceeds a given value. This figure is based on an 18%-Ni-base maraging steel cylinder which has been drawn, leaving a residual stress of 100 kg/mm². The aging was carried out at 510° C × 3 hours. As is clear from FIG. 14, even if the residual tensile stress were as high as 100 kg/mm², an ironing ratio over 20 percent would reduce the residual stress to below +10 kg/mm², which is negligible. In this respect, for producing a cylinder having satisfactory dimensional accuracy, the total ironing ratio should suitably be in the range of 50 to 70 percent. The ironing step is carried out in several stages, at an ironing ratio of 10 to 30 percent for each stage. In addition, since maraging steel affords a high yield point (80 to 90 kg/mm²) even in the quenched state, the blank holding force should be increased with ordinary lubricating to three or four times that required for an ordinary mild steel. Alternatively, if the ironing step is carried out continuously in a tandem fashion, the ironing operations may be carried out in a single step, with a resultant saving in production time.

The cylinders which have been subjected to the ironing step are then aged at a temperature of 450° to 550° C. The variation in wall thickness of cylinders thus produced ranges within 3/100 mm and the variation in straightness is below 2/100 mm, as will be described in the Examples below. The limits of the variations in the wall thickness and straightness of cylinders subjected to spinning are 5/100 mm and 0.3 mm, respectively. As these figures indicate, cylinders made according to the present invention possess excellent dimensional accuracy, as well as insuring stable high speed rotation.

Having generally described the invention, a more complete understanding can be obtained by reference to certain specific examples, which are included for purposes of illustration only and are not intended to be limiting unless otherwise specified.

EXAMPLE 1

A disk-like maraging steel plate or blank having a composition of 0.013% C, 0.03% Si, 0.06% Mn, 0.0005% P, 0.005% S, 18.31% Ni, 9.41% Co, 4.94% Mo, 0.69% Ti and 0.131% Al, and a thickness of 1.2 mm was subjected to drawing and ironing under the following conditions:

Drawing step (in three stages):

| Stage | Diameter of punch (mm) | Inner diameter of die (mm) |
|---|---|---|
| The last stage | 300.0 | 302.6 |
| The 2nd stage | 250.0 | 252.7 |
| The 3rd stage | 200.0 | 202.9 |

Ironing step (in six stages):

| Stage | Diameter of punch (mm) | Inner diameter of die (mm) | Ironing ratio (%) |
|---|---|---|---|
| The 1st stage | 200.0 | 201.8 | 25.0 |
| The 2nd stage | 200.0 | 201.6 | 11.1 |
| The 3rd stage | 200.0 | 201.4 | 12.5 |
| The 4th stage | 200.0 | 201.2 | 14.3 |
| The 5th stage | 200.0 | 201.0 | 16.7 |
| The 6th stage | 200.0 | 200.9 | 10.0 |

In the first drawing stage, polyethylene double films were used as a lubricant between the plate and the die, while corrosion oil No. 60 was used between the plate and the blank holder. In the second and third drawing stage, a paste consisting of a mixture of oil and molybdenum disulfide was used as the lubricant. In the ironing step, molybdenum disulfide was used as the lubricant.

The cylinders thus worked and treated were subjected to aging at 500° C for 3 hours. The dimensions of the cylinders thus produced were 780 mm in height, 200.0 mm in inner diameter and 0.456 mm in thickness. The residual stress of the aforesaid cylinders was as low as +1.0 kg/mm², which is negligible.

EXAMPLE 2

The same procedures were followed for the disk-like maraging steel plate with thickness of 0.8 mm and a composition of 0.01% C, 0.05% Si, 0.06% Mn, 0.005% P, 0.005% S, 17.77% Ni, 9.25% Co, 4.88% Mo, 0.74% Ti and 0.11% Al.

Drawing step (in three stages)

| Stage | Diameter of punch (mm) | Inner diameter of die (mm) |
|---|---|---|
| The 1st stage | 50 | 52.4 |
| The 2nd stage | 40 | 43.0 |
| The 3rd stage | 30 | 35.4 |

Ironing step (in six stages)

| Stage | Diameter of punch (mm) | Inner diameter of die (mm) | Ironing ratio (%) |
|---|---|---|---|
| The 1st stage | 32.2 | 33.54 | 16.20 |
| The 2nd stage | 32.2 | 33.20 | 25.37 |
| The 3rd stage | 32.2 | 33.00 | 20.00 |
| The 4th stage | 32.2 | 32.80 | 25.00 |
| The 5th stage | 32.2 | 32.70 | 16.67 |
| The 6th stage | 32.2 | 32.60 | 20.00 |

In the first drawing stage, polyethylene double films were used as a lubricant between the blank and die blank holder, while machine oil was used in the second and third drawing stages. In the ironing step, a paste consisting of oil and molybdenum disulfide was used as the lubricant.

Cylinders thus prepared were subjected to aging at 500° C for 3 hours. The dimensions of the cylinders were 210 mm in height, 32.6 mm in outer diameter and 0.254 mm in wall thickness.

Table 1 shows the results of measurements of the residual stress of cylinders made according to the present invention and those subjected to spinning.

Table 1

| | Results of measurements of residual stress (kg/mm²) | |
|---|---|---|
| | Cylinders of present invention | Cylinders subjected to spinning |
| As worked | G2/ 5.5 | 65 |
| Worked and subjected to aging | 0.05 | 44 |

Figure 15A:
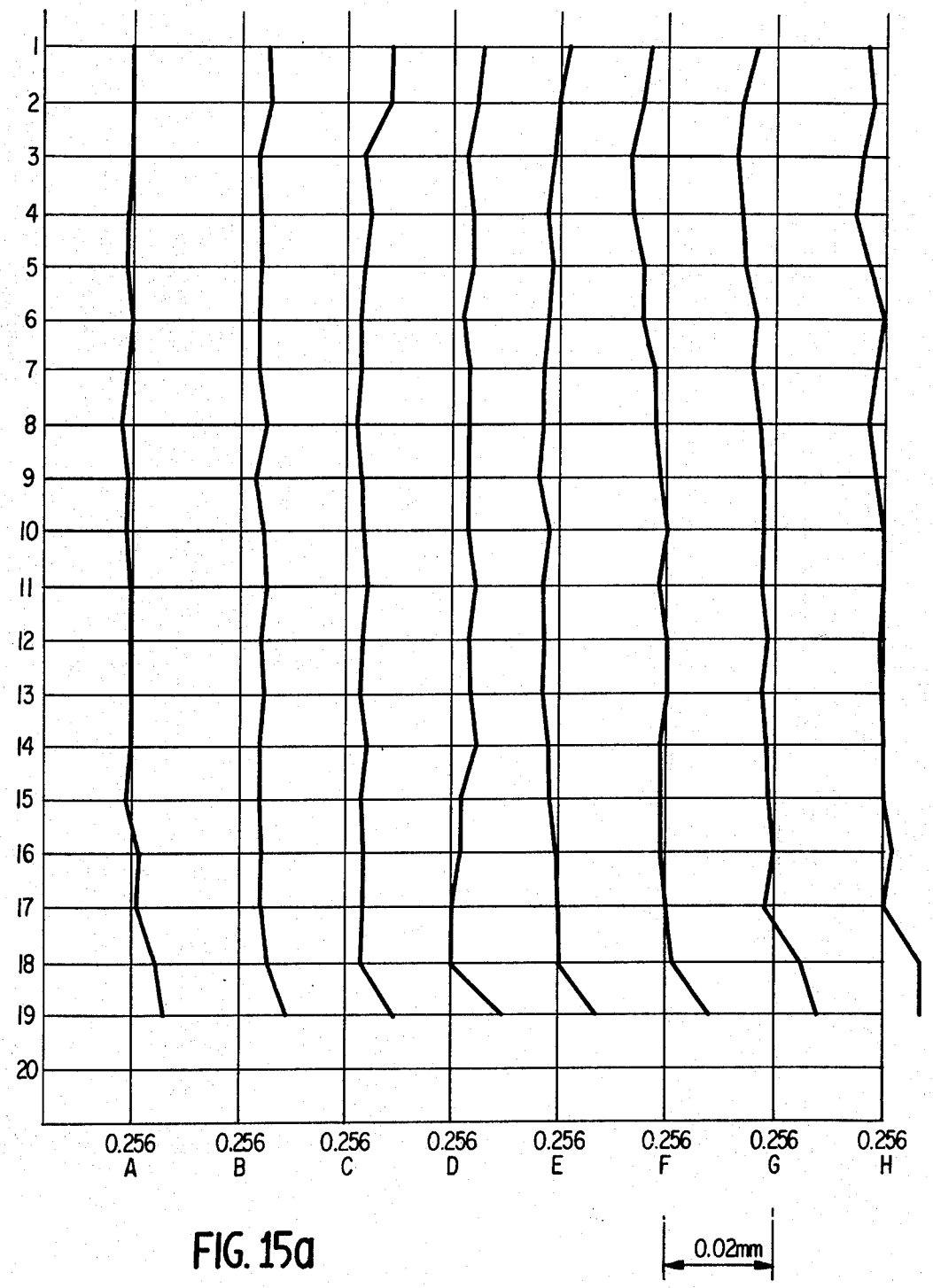
FIGS. 15(*a*) and (*b*) are plots showing the measurements of the wall thickness in the (*a*) longitudinal and (*b*) circumferential directions.
Figure 15B:
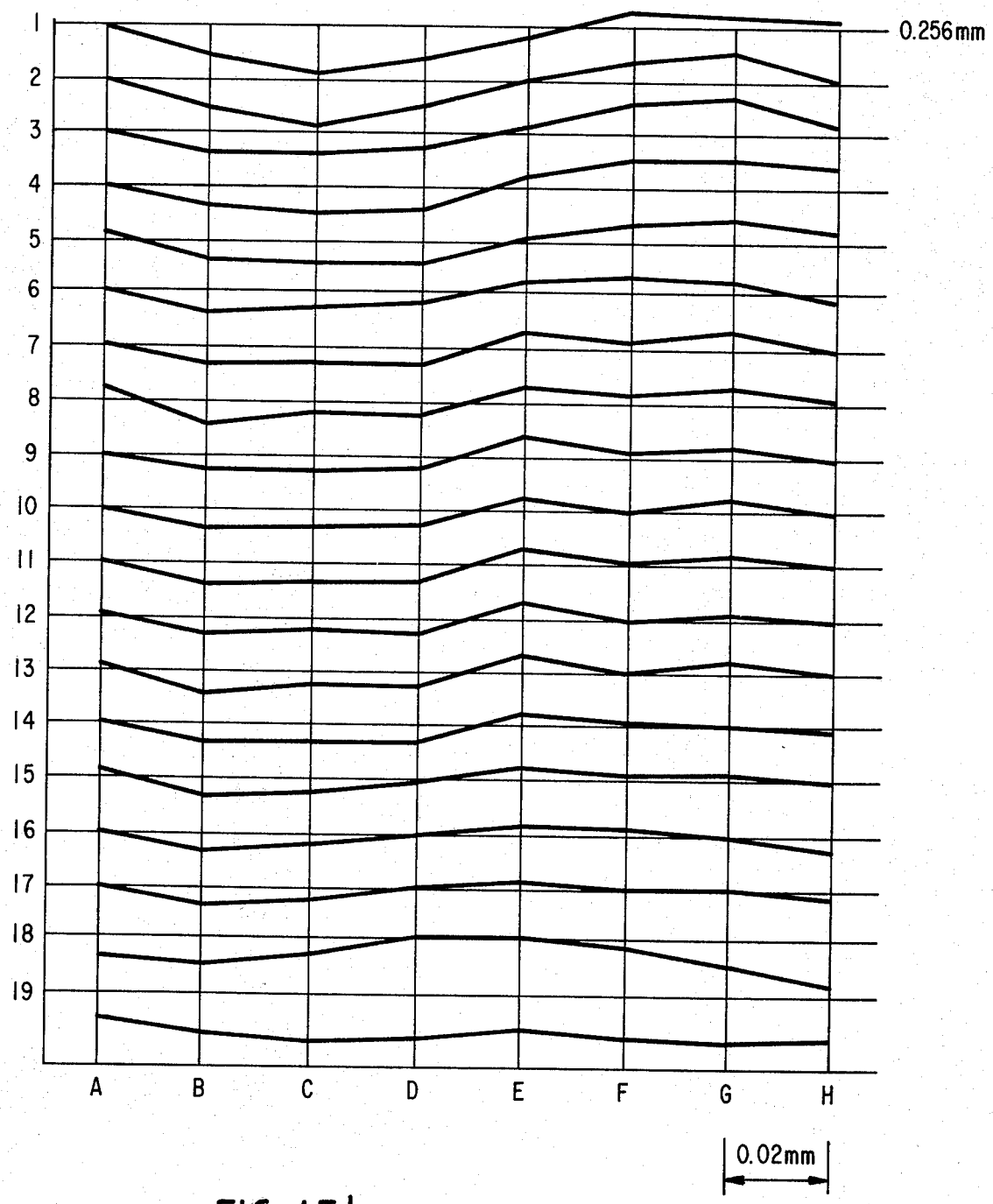

The variation in wall thickness of cylinders made according to the present invention is less than 1/100 mm. The variation in wall thickness of cylinders subjected to the prior art spinning is as high as 5/100 mm. In this connection, FIG. 15 shows the distribution of wall thickness of cylinders measured at the measuring points shown in FIG. 16. FIG. 15(*a*) refers to longitudinal variation, while FIG. 15(*b*) refers to circumferential variation.

Table 2 shows the deviation from a perfectly round surface and the straightness of cylinders measured at the measuring points shown in FIG. 17. The straightness of the cylinders made according to the present invention is less than 1/100 mm, while that of the cylinders subjected to spinning is as high as 0.3 mm.

Table 2

| | Deviation from a perfectly round surface and straightness (mm) | | | | |
|---|---|---|---|---|---|
| | 1 | 2 | 3 | 4 | 5 |
| Deviation from a perfectly round surface | 0.095 | 0.035 | 0.070 | 0.060 | 0.020 |
| Straightness | | | 0.0015 | | |

EXAMPLE 3

Local aging or heating was applied to a maraging steel plate at temperatures varying from 500° to 850° C for 2, 5, 15, 30 and 60 minutes in increments of 50° C starting with 500° C. The L.D.R. increased from 2.26 to 2.95 due to local aging applied at 600° to 620° C for 2 minutes.

Table 3 shows the deep drawing conditions.

TABLE 3

| | | |
|---|---|---|
| Tool | diameter of punch<br>diameter of die<br>die profile radius | 33 mm<br>34.5 mm<br>4.5 mm |
| Blank diameter | 66 mm – 108 mm | |
| Oil lubricant | polyethylene double films | |
| Blank holding force (calculated from the equations shown on the right) | $Q_{min} = \pi/4\ [D_o^2 - (d_1 + 2r_d)^2]\ q\ min$<br>$q_{min} = 48(Z - 1.1)D_o/t\ \sigma\beta \times 10_{-}^{6}$<br>$Q_{min}$: lower limit of blank holding<br>$q_{min}$: lower limit of blank holding force per unit area of blank<br>$D_o$: diameter of blank<br>$d_1$: diameter of die<br>$r_d$: die profile radius<br>Z: drawing ratio<br>$\sigma\beta$: tensile strength of blank<br>t: thickness of blank | |
| Punch speed | 12 mm/min | |

As is apparent from the foregoing description, the process according to the present invention meets the requirements for rotors or cylinders which have been enumerated earlier, i.e., dimensional accuracy, freedom from residual stress in the products, desired strength including strength against rupture due to internal pressure, tensile strength, and the like.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A process for producing a maraging steel cylinder for a uranium enriching centrifugal separator, which comprises:

drawing a blank of a maraging steel into a cylindrical shape;

ironing said drawn blank until an ironing ratio of at least 20 percent is achieved; and subjecting the cylinder thus ironed to aging.

2. The process of claim 1, wherein said maraging steel is an 18%-Ni maraging steel alloy.

3. The process of claim 2, wherein said 18%-Ni maraging steel alloy is selected from the group consisting of KMS 18–17, 18–20 and 18–24 maraging steel alloys.

4. The process of claim 1, which further comprises prior to said drawing, solution heat treating said steel at a temperature above the temperature which yields the maximum amount of retained austenite in the as-solution-heat-treated state.

5. The process of claim 4, wherein said temperature ranges from 600° to 650° C.

6. The process of claim 4, wherein the temperature above said temperature which gives the maximum amount of retained austenite ranges from 650° to 700° C.

7. The process of claim 1, wherein said drawing and said ironing step are each conducted in a plurality of stages.

8. The process of claim 6, wherein said ironing is conducted in a plurality of stages at an ironing ratio of 10 to 30 percent in each stage.

9. The process of claim 1, wherein said aging is applied to a load bearing portion of said blank which has been drawn at least once.

10. The process of claim 9, wherein said aging is applied at a temperature ranging from 600° to 620° C for 2 minutes.

11. A maraging steel cylinder produced according to the process of claim 1.

12. The maraging steel cylinder of claim 11, wherein the variation in the longitudinal and circumferential wall thickness of said cylinder is less than 3/100 mm.

13. The maraging-steel cylinder of claim 11, wherein the straightness of said cylinder is less than 2/100 mm.

14. The maraging steel cylinder of claim 11, wherein the residual stress in the circumferential direction in the wall of said cylinder is less than +10kg/mm².

* * * * *